US008389859B2

(12) United States Patent
Huang

(10) Patent No.: US 8,389,859 B2
(45) Date of Patent: Mar. 5, 2013

(54) MODULAR POWER CONNECTOR

(75) Inventor: Chin-Chu Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 285 days.

(21) Appl. No.: 12/884,402

(22) Filed: Sep. 17, 2010

(65) Prior Publication Data

US 2011/0067922 A1 Mar. 24, 2011

(30) Foreign Application Priority Data

Sep. 18, 2009 (TW) ..... 98131630 A

(51) Int. Cl.
*H01R 4/72* (2006.01)

(52) U.S. Cl. ..... 174/84 C

(58) Field of Classification Search ..... 174/84 R, 174/88 R, 84 C; 403/201
See application file for complete search history.

(56) References Cited

U.S. PATENT DOCUMENTS

| | | | | |
|---|---|---|---|---|
| 1,449,727 | A * | 3/1923 | Bowman | 403/201 |
| 2,691,145 | A * | 10/1954 | Watts | 439/346 |
| 3,288,915 | A * | 11/1966 | Hatfield et al. | 174/94 R |
| 4,815,983 | A * | 3/1989 | Erickson et al. | 439/173 |
| 6,220,872 | B1 * | 4/2001 | Chen | 439/76.1 |
| 2009/0036002 | A1 * | 2/2009 | Arai | 439/825 |

FOREIGN PATENT DOCUMENTS

| | | |
|---|---|---|
| CN | 1434548 | 8/2003 |
| CN | 1564380 | 1/2005 |
| JP | 7147490 | 6/1995 |
| JP | 7208413 | 8/1995 |
| JP | 8230470 | 9/1996 |
| JP | 9118176 | 5/1997 |

* cited by examiner

*Primary Examiner* — Chau Nguyen
(74) *Attorney, Agent, or Firm* — Kirton McConkie; Evan R. Witt

(57) ABSTRACT

A modular power connector includes an insulation main body, at least one conducting element, at least one electricity-delivering element, and at least one engaging element. The conducting element is partially accommodated within the insulation main body, and includes a perforation. The electricity-delivering element has a bare part at an end thereof. The engaging element is fixed on the bare part of the electricity-delivering element, and includes an elastic extension part and a stopping part. The elastic extension part is subject to elastic deformation during the elastic extension part is penetrated through the perforation of the conducting element. The elastic extension part is restored to an original shape after the elastic extension part is penetrated through the perforation, so that the conducting element is clamped between the elastic extension part and the stopping part.

11 Claims, 7 Drawing Sheets

MODULAR POWER CONNECTOR

FIELD OF THE INVENTION

The present invention relates to a power connector, and more particularly to a modular power connector.

BACKGROUND OF THE INVENTION

Power connectors are used as connective interfaces in various power delivery systems. For assuring secure contact between two power connectors, these two power connectors have respective mechanical fastening elements for fixing the conductors within the power input sides of the power connectors.

FIG. 1A is a schematic perspective view illustrating a modular power connector according to the prior art. The modular power connector 10 comprises an insulation main body 101, a first conducting terminal 103, a second conducting terminal 104, a first conducting pin (not shown), a second conducting pin 105 and two power wires 106. A receptacle 102 is disposed within the insulation main body 101 for accommodating the first conducting terminal 103 and the second conducting terminal 104. The first conducting terminal 103 and the second conducting terminal 104 penetrate through corresponding holes (not shown), which are formed in the backside of the insulation main body 101. The first conducting terminal 103 and the second conducting terminal 104 are respectively coupled with the first conducting pin and the second conducting pin 105 by a welding means or a riveting means. In addition, one of the two power wires 106 has a first end connected to the first conducting pin and a second end connected to an internal circuit board (not shown) of the electronic device. The other of the two power wires 106 has a first end connected to the second conducting pin 106 and a second end connected to the internal circuit board of the electronic device. As such, the modular power connector 10 could be electrically connected with the internal circuit board of the electronic device.

FIG. 1B is a schematic perspective view illustrating the second conducting pin of the modular power connector as shown in FIG. 1A. As shown in FIG. 1B, the second conducting pin 105 comprises an opening 1051, a perforation 1052 and a wire-securing part 1053. The second conducting pin 105 is aligned with a corresponding hole of the backside of the insulation main body 101. Through the hole and the opening 1051, the second conducting terminal 104 is coupled with the second conducting pin 105 by welding or riveting. A bare part 1061 at the first end of the power wire 106 is penetrated through the perforation 1052 of the second conducting pin 105, and then wrapped around the wire-securing part 1053 for at least one turn (see FIG. 1C). Then, solder paste 107 is applied on the bare part 1061 of the power wire 106, so that the bare part 1061 of the power wire 106 is fastened onto the wire-securing part 1053 by welding (see FIG. 1D).

Although the connection between the power wire 106 and the second conducting pin 105 meets the electrical safety regulation, there are still some drawbacks. For example, the power wire 106 is mechanically fastened onto the second conducting pin 105 after the bare part 1061 of the power wire 106 is penetrated through the perforation 1052 of the second conducting pin 105 and wrapped around the wire-securing part 1053. Since the power wire 106 and the second conducting pin 105 are very small in sizes, it is difficult to penetrate the power wire 106 through the perforation 1052 and wrap the power wire 106 around the wire-securing part 1053 at the lateral side of the insulation main body 101. Under this circumstance, the assembling process of the power connector is troublesome and the throughput thereof is undesired.

Therefore, there is a need of providing a modular power connector so as to obviate the drawbacks encountered in the prior art.

SUMMARY OF THE INVENTION

An object of the present invention provides an easily-assembled and simple modular power connector in order to increase the throughput.

Another object of the present invention provides a modular power connector, in which a conducting element is mechanically coupled with an engaging element.

In accordance with an aspect of the present invention, there is provided a modular power connector of an electronic device. The modular power connector includes an insulation main body, at least one conducting element, at least one electricity-delivering element, and at least one engaging element. The conducting element is partially accommodated within the insulation main body, and includes a perforation. The electricity-delivering element has a bare part at an end thereof. The engaging element is fixed on the bare part of the electricity-delivering element, and includes an elastic extension part and a stopping part. The elastic extension part is subject to elastic deformation during the elastic extension part is penetrated through the perforation of the conducting element. The elastic extension part is restored to an original shape after the elastic extension part is penetrated through the perforation, so that the conducting element is clamped between the elastic extension part and the stopping part.

In an embodiment, the electronic device is a power adapter, a power supply apparatus or a transformer.

In an embodiment, the conducting element includes a conducting terminal and a conducting pin. The conducting terminal and the conducting pin are connected with each other. The conducting terminal is accommodated within a receptacle of the insulation main body. The conducting pin is at least partially exposed outside the insulation main body and comprises the perforation.

In an embodiment, the conducting terminal and the conducting pin are integrally formed.

In an embodiment, the conducting terminal and the conducting pin are connected with each other by welding or riveting.

In an embodiment, the conducting pin is a metallic sheet.

In an embodiment, the electricity-delivering element is a power wire.

In an embodiment, a fastening recess is defined between the elastic extension part and the stopping part, so that the conducting element is fixed in the fastening recess.

In an embodiment, the engaging element is produced by machining and bending a metallic sheet, so that the elastic extension part and the stopping part are extended outwardly from the engaging element.

In an embodiment, the elastic extension part includes at least one elastic slice.

In an embodiment, the stopping part includes at least one rib.

In an embodiment, the modular power connector further includes an insulating cover sheathed around the electricity-delivering element, wherein the insulating cover is sustained against the stopping part of the engaging element.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
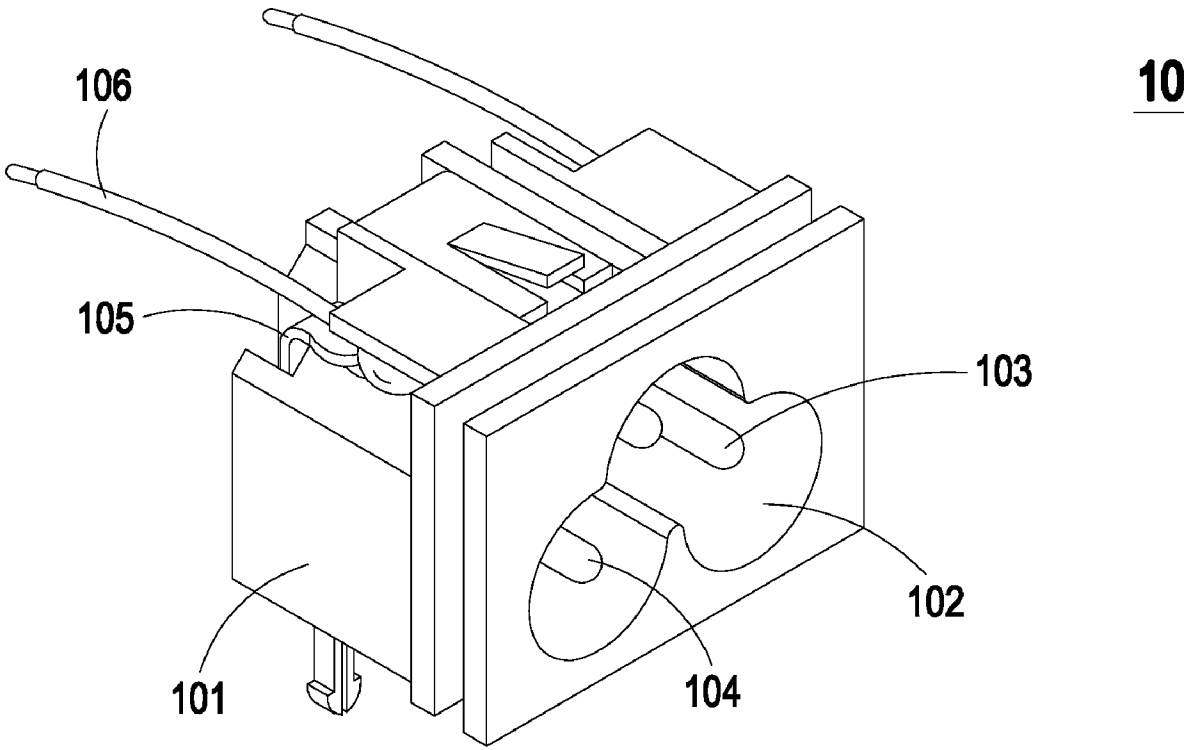
FIG. 1A PRIOR ART
FIG. 1A is a schematic perspective view illustrating a modular power connector according to the prior art.
Figure 1D:
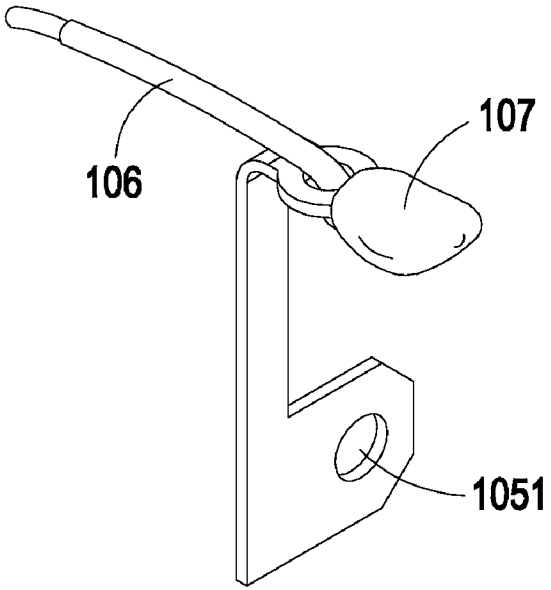
FIG. 1D PRIOR ART
FIG. 1D is a schematic perspective view illustrating the bare part of the power wire fastening on the wire-securing part of the second conducting pin as shown in FIG. 1C.
Figure 1C:
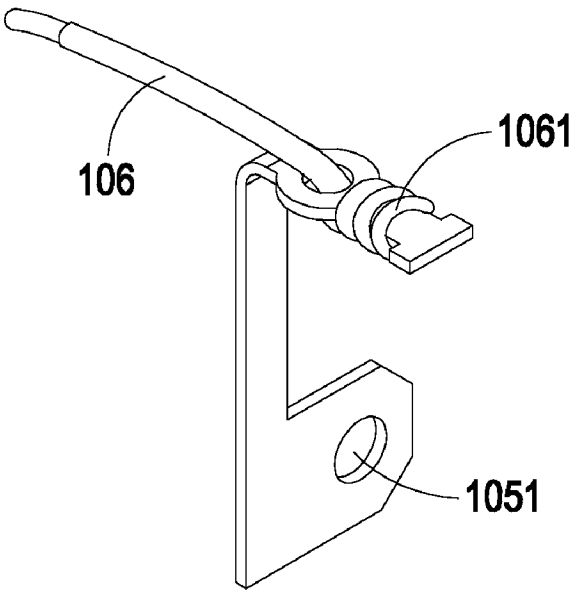
FIG. 1C PRIOR ART
FIG. 1C is a schematic perspective view illustrating a bare part of the power wire wrapped around a wire-securing part of the second conducting pin as shown in FIG. 1B.
Figure 1B:
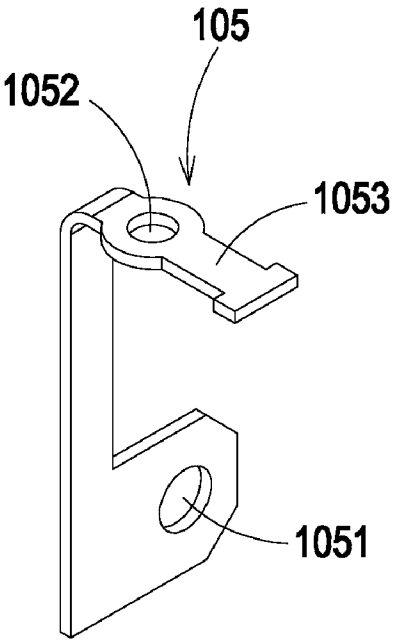
FIG. 1B PRIOR ART
FIG. 1B is a schematic perspective view illustrating the second conducting pin of the modular power connector as shown in FIG. 1A.
Figure 2A:
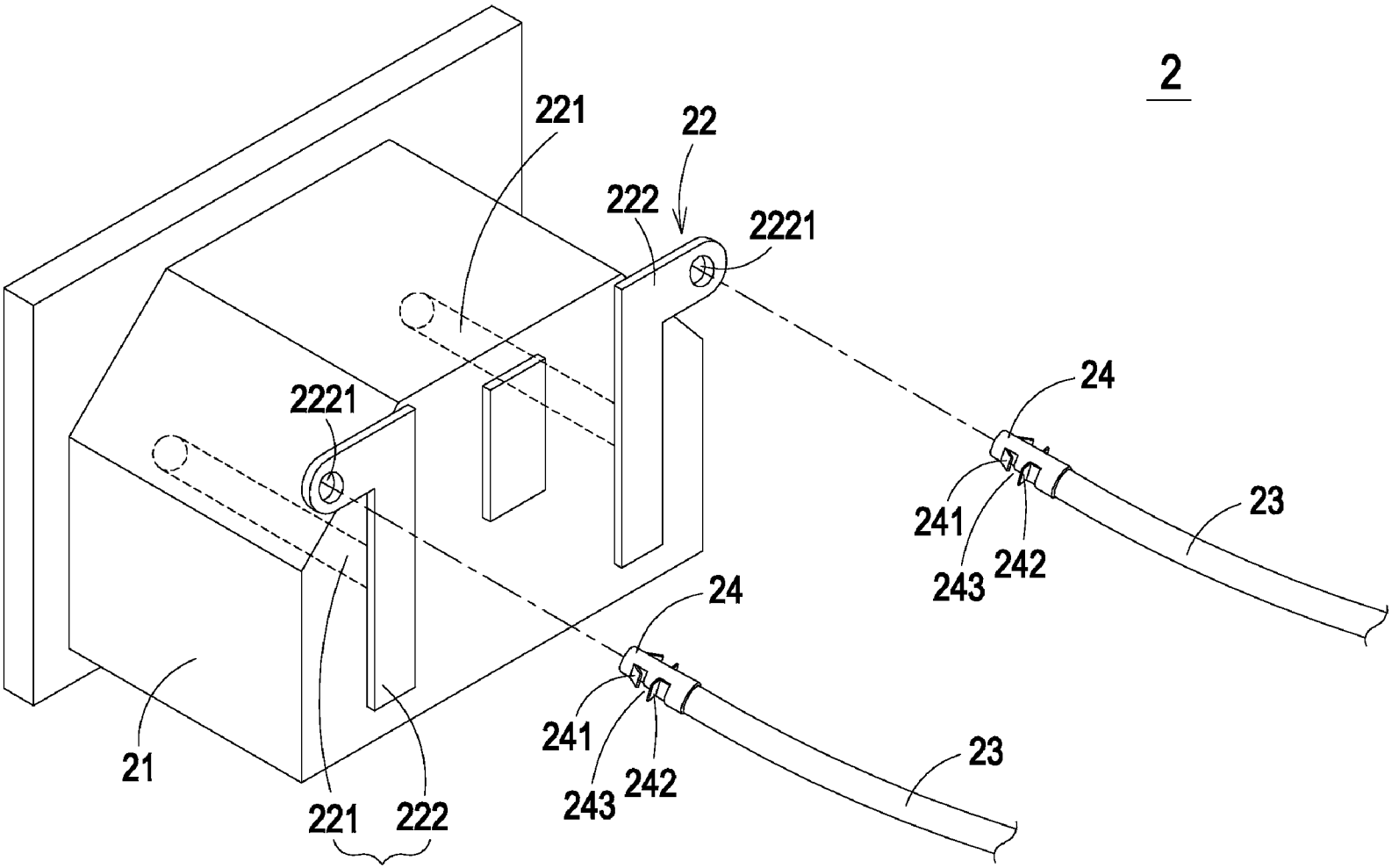
FIG. 2A is a schematic exploded view illustrating a modular power connector according to an embodiment of the present invention.
Figure 2B:
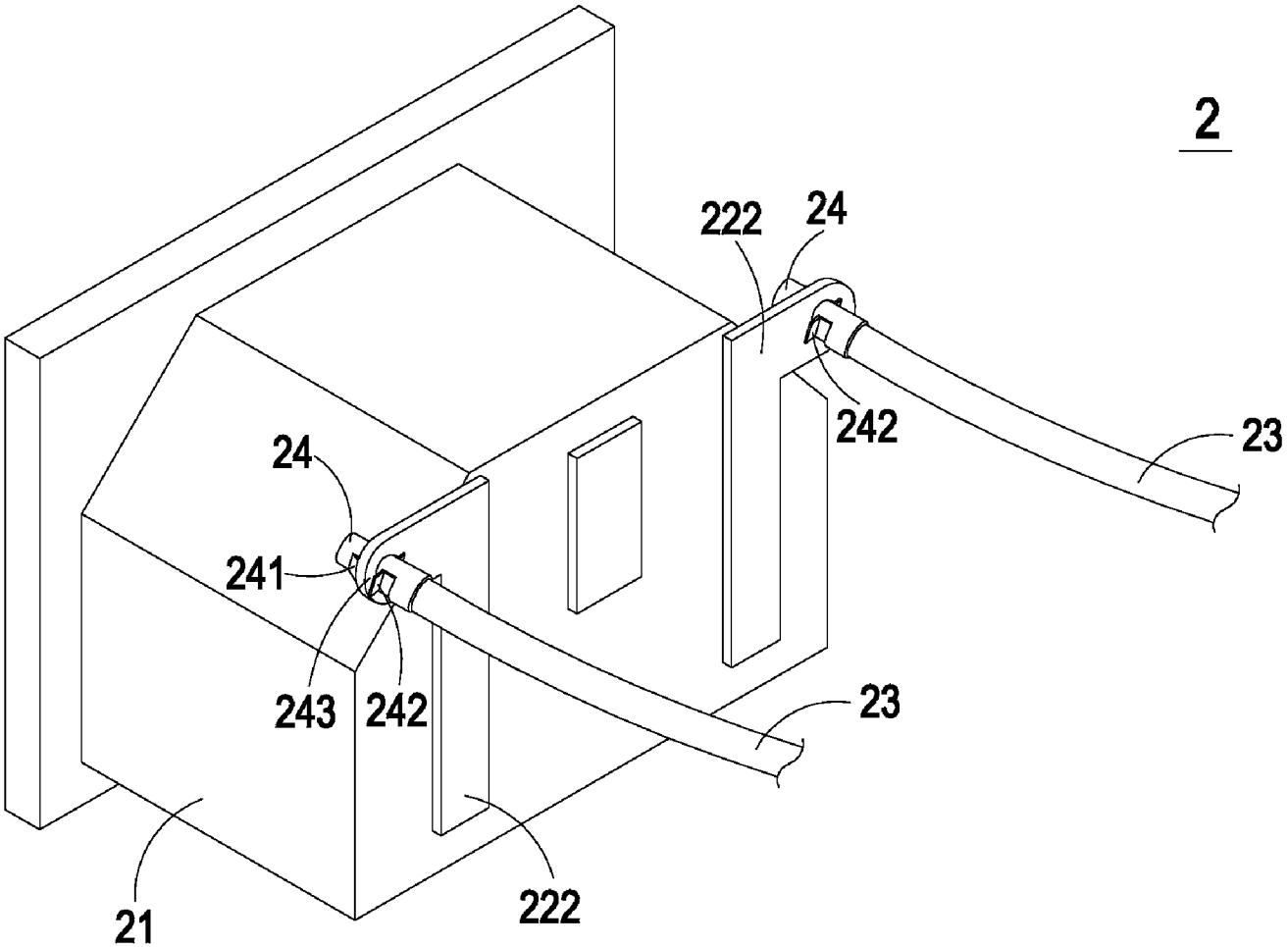
FIG. 2B is a schematic assembled view illustrating the modular power connector of FIG. 2A.

FIG. 2A is a schematic exploded view illustrating a modular power connector according to an embodiment of the present invention. FIG. 2B is a schematic assembled view illustrating the modular power connector of FIG. 2A. Please refer to FIGS. 2A and 2B. The modular power connector could be applied to an electronic device such as a power adapter, a power supply apparatus or a transformer. As shown in FIG. 2A, the modular power connector 2 comprises an insulation main body 21, one or more conducting elements 22, one or more electricity-delivering elements 23, and one or more engaging elements 24. Each of the conducting elements 22 comprises a conducting terminal 221 and a conducting pin 222. The conducting terminal 221 and the conducting pin 222 are connected with each other. The conducting terminal 221 is accommodated within a receptacle (not shown) of the insulation main body 21 for receiving external input power. The conducting pin 222 is at least partially exposed outside the insulation main body 21. For example, the conducting pin 222 is exposed to the backside of the insulation main body 21. The conducting pin 222 has a perforation 2221. In some embodiments, the conducting element 22 is made of metallic material. The conducting terminal 221 and the conducting pin 222 of the conducting element 22 are substantially perpendicular to each other. It is preferred that the conducting terminal 221 and the conducting pin 222 are integrally formed. Alternatively, the conducting terminal 221 and the conducting pin 222 are connected with each other by a welding means or a riveting means. In some embodiments, the conducting terminal 221 has a hollow wall. The conducting pin 222 is slab-like or sheet-like.

Figure 3:
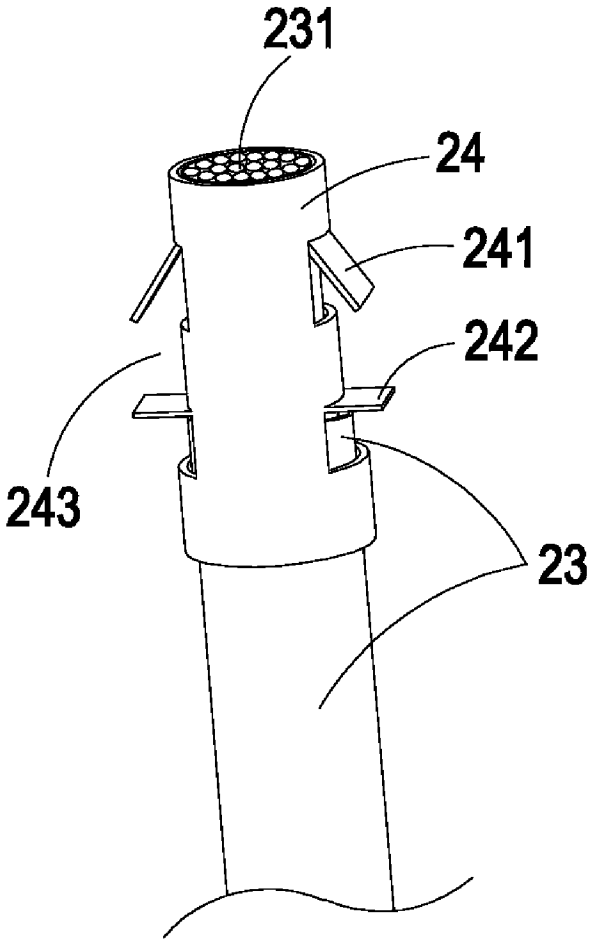
FIG. 3 is a schematic perspective view illustrating a combination of an electricity-delivering element and an engaging element of the modular power connector of the present invention.

FIG. 3 is a schematic perspective view illustrating a combination of an electricity-delivering element and an engaging element of the modular power connector of the present invention. Please refer to FIGS. 2A and 3. An example of the electricity-delivering element 23 is a power wire having a bare part 231 at an end thereof. The engaging element 24 is fixed on and sheathed around the bare part 231 of the electricity-delivering element 23, so that the electricity-delivering element 23 and the engaging element 24 are electrically and structurally connected with each other. The engaging element 24 is made of conductive material. In addition, the engaging element 24 could be produced by machining and bending a metallic sheet such that an elastic extension part 241 and a stopping part 242 are extended outwardly from the engaging element 24. In an embodiment, the elastic extension part 241 includes two elastic slices, which are extended from two opposite sides of the engaging element 24. The stopping part 242 includes two ribs, which are extended from two opposite sides of the engaging element 24. The ribs of the stopping part 242 are substantially perpendicular to the main body of the engaging element 24. Especially, a fastening recess 243 is defined between the elastic extension part 241 and the stopping part 242. In addition, the elastic extension part 241 is closer to the tip of the bare part 231 than the stopping part 242.

Figure 4B:
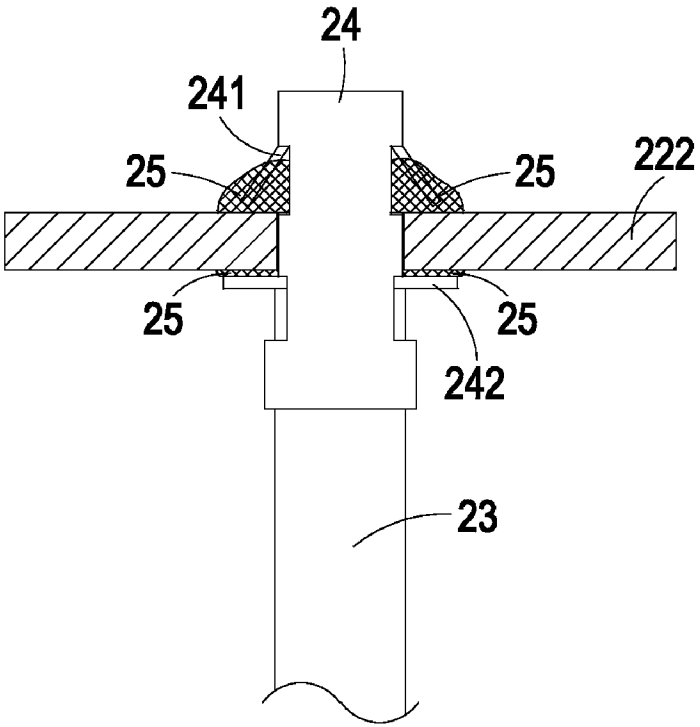
FIG. 4B is a schematic cross-sectional view illustrating a procedure of applying solder paste on the resulting structure of FIG. 4A.
Figure 4A:
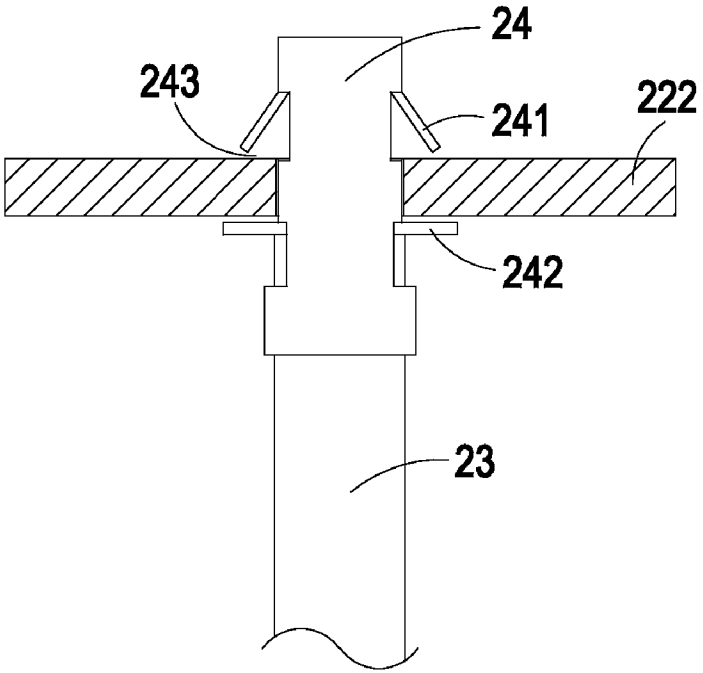
FIG. 4A is a schematic cross-sectional view illustrating the conducting pin clamped between the elastic extension part and the stopping part of the engaging element.
Figure 5:
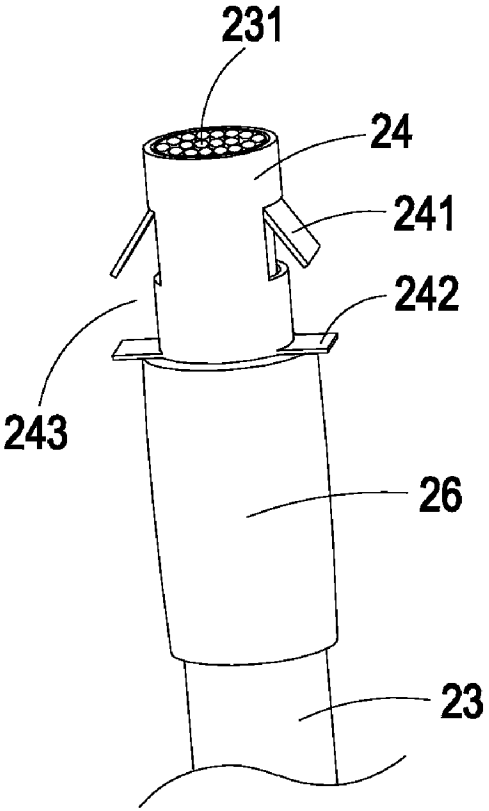
FIG. 5 is a schematic perspective view illustrating an insulation cover sheathed around the electricity-delivering element.

Hereinafter, a process of connecting the engaging element 24 with the conducting pin 222 of the conducting elements 22 will be illustrated with reference to FIG. 2A. During the elastic extension part 241 is penetrated through the perforation 2221 of the conducting pin 222, the elastic extension part 241 is compressed by the inner wall of the perforation 2221 such that the elastic extension part 241 is subject to elastic deformation. As such, the elastic extension part 241 could be advanced. After the elastic extension part 241 is penetrated through the perforation 2221, the elastic extension part 241 is restored to its original shape. As a consequence, the conducting pin 222 of the conducting element 22 is clamped between the elastic extension part 241 and the stopping part 242. That is, the conducting pin 222 is fixed in the fastening recess 243 (see also FIGS. 2B and 4A). Since the engaging element 24 is fixed on the conducting pin 222 of the conducting element 22 at this moment, the electricity-delivering element 23 is electrically connected with the conducting element 22 through the engaging element 24. This connecting mechanism is a mechanical fasting mechanism complying with the electrical safety regulation. Next, solder paste 25 is applied on the region between the elastic extension part 241 and the conducting pin 222 and the region between the stopping part 242 and the conducting pin 222, thereby securely fixing the engaging element 24 on the conducting element 22 (see FIG. 4B). The first end of the electricity-delivering element 23 could be electrically connected with the conducting element 22 through the engaging element 24. In addition, a second end of the electricity-delivering element 23 could be electrically connected with a conductive hole (not shown) through another engaging element 24. As a consequence, the modular power connector 2 is electrically connected with the circuit board of the electronic device through the electricity-delivering element 23 and the engaging element 24.

In some embodiments, the number of conducting elements 22 is two or three. The number of electricity-delivering elements 23 is the same as the number of the conducting elements 22.

For increasing the electrical safety distance between the electrical joint and the adjacent component or conductor, the modular power connector 2 further comprises an insulating cover 26. The insulating cover 26 is partially sheathed around the electricity-delivering element 23. The insulating cover 26 is sustained against the stopping part 242 of the engaging element 24.

From the above description, the modular power connector of the present invention is easily assembled and has a simple configuration. During the elastic extension part of the engaging element is penetrated through the perforation of the conducting element, the elastic extension part is compressed by the inner wall of the perforation such that the elastic extension part is subject to elastic deformation. After the elastic extension part is penetrated through the perforation, the elastic extension part is restored to its original shape. As a consequence, the conducting element is clamped between the elastic extension part and the stopping part. Since the conducting element is mechanically coupled with the engaging element, the conducting element is not easily detached from the electricity-delivering element even if the no solder paste is used. Moreover, since the modular power connector of the present invention is easily assembled and has a simple configuration, the throughput of the modular power connector is increased.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A modular power connector of an electronic device, said modular power connector comprising:

an insulation main body;

at least one conducting element partially accommodated within said insulation main body, and comprising a perforation;

at least one electricity-delivering element having a bare part at an end thereof;

an insulating cover sheathed around said electricity-delivering element; and at least one engaging element fixed on said bare part of said electricity-delivering element, and comprising an elastic extension part and a stopping part, wherein said insulating cover is sustained against said stopping part of said engaging element, said elastic extension part is subject to elastic deformation during said elastic extension part is penetrated through said perforation of said conducting element, and said elastic extension part is restored to an original shape after said elastic extension part is penetrated through said perforation, so that said conducting element is clamped between said elastic extension part and said stopping part.

2. The modular power connector according to claim 1 wherein said electronic device is a power adapter, a power supply apparatus or a transformer.

3. The modular power connector according to claim 1 wherein said conducting element comprises a conducting terminal and a conducting pin, said conducting terminal and said conducting pin are connected with each other, said conducting terminal is accommodated within a receptacle of said insulation main body, and said conducting pin is at least partially exposed outside said insulation main body and comprises said perforation.

4. The modular power connector according to claim 3 wherein said conducting terminal and said conducting pin are integrally formed.

5. The modular power connector according to claim 3 wherein said conducting terminal and said conducting pin are connected with each other by welding or riveting.

6. The modular power connector according to claim 3 wherein said conducting pin is a metallic sheet.

7. The modular power connector according to claim 1 wherein said electricity-delivering element is a power wire.

8. The modular power connector according to claim 1 wherein a fastening recess is defined between said elastic extension part and said stopping part, so that said conducting element is fixed in said fastening recess.

9. The modular power connector according to claim 1 wherein said engaging element is produced by machining and bending a metallic sheet, so that said elastic extension part and said stopping part are extended outwardly from said engaging element.

10. The modular power connector according to claim 9 wherein said elastic extension part includes at least one elastic slice.

11. The modular power connector according to claim 9 wherein said stopping part includes at least one rib.

* * * * *